US008534317B2

(12) United States Patent
Plunkett et al.

(10) Patent No.: US 8,534,317 B2
(45) Date of Patent: Sep. 17, 2013

(54) HYDRAULICALLY CONTROLLED BARRIER VALVE EQUALIZING SYSTEM

(75) Inventors: Kevin R. Plunkett, Coweta, OK (US); Robert J. Dyer, Coweta, OK (US)

(73) Assignee: Baker Hughes Incorporated, Houston, TX (US)

( * ) Notice: Subject to any disclaimer, the term of this patent is extended or adjusted under 35 U.S.C. 154(b) by 449 days.

(21) Appl. No.: 12/837,161

(22) Filed: Jul. 15, 2010

(65) Prior Publication Data

US 2012/0012327 A1 Jan. 19, 2012

(51) Int. Cl.
*F16K 31/00* (2006.01)

(52) U.S. Cl.
USPC ..... 137/601.01; 137/629; 251/58

(58) Field of Classification Search
USPC ..... 137/601.13, 601.15, 601.16, 614.11, 137/629; 251/58; 166/324, 332.3, 334.2
See application file for complete search history.

(56) References Cited

U.S. PATENT DOCUMENTS

| | | | | |
|---|---|---|---|---|
| 3,741,249 | A | 6/1973 | Leutwyler | |
| 3,827,494 | A | 8/1974 | Crowe | |
| 3,847,218 | A | 11/1974 | Boyadjieff et al. | |
| 3,853,175 | A | 12/1974 | Boyadjieff et al. | |
| 3,971,438 | A | 7/1976 | Crowe | |
| 4,103,744 | A | 8/1978 | Akkerman | |
| 4,144,937 | A | 3/1979 | Jackson et al. | |
| 4,289,165 | A | 9/1981 | Fredd | |
| 4,368,871 | A | 1/1983 | Young | |
| 4,448,216 | A | 5/1984 | Speegle et al. | |
| 4,452,311 | A | 6/1984 | Speegle et al. | |
| 4,478,286 | A | 10/1984 | Fineberg | |
| 5,890,698 | A | 4/1999 | Domytrak | |
| 6,109,351 | A | 8/2000 | Beall | |
| 6,644,408 | B2 | 11/2003 | Ives | |
| 6,848,509 | B2 | 2/2005 | Myerley | |
| 6,866,100 | B2 | 3/2005 | Gudmestad et al. | |
| 6,877,564 | B2 | 4/2005 | Layton et al. | |
| 7,537,052 | B2 | 5/2009 | Robichaux et al. | |
| 7,905,292 | B2 * | 3/2011 | Beall et al. | 166/332.7 |
| 2009/0184278 | A1 | 7/2009 | Beall et al. | |
| 2011/0079394 | A1 * | 4/2011 | Plunkett et al. | 166/324 |

OTHER PUBLICATIONS

Caledyne Fact Sheet, "Mechanical Isolation Valve", 2009, 2 pages.
Caledyne Product Information Sheet, "Mechanical Isolation Valve", 2006, 1 page.

* cited by examiner

*Primary Examiner* — John K Fristoe, Jr.
*Assistant Examiner* — Reinaldo Sanchez-Medina
(74) *Attorney, Agent, or Firm* — Steve Rosenblatt

(57) ABSTRACT

A barrier valve has an equalizing feature for the ball or plug when in the closed position before it is opened. A hydraulic open and a close line are connected to a housing so that they can move a piston in opposed directions. The piston ends are sealed and the exterior of the piston is tapered to push one or more bypass valves open to connect tubing pressure across the ball when ramped off its seat. Pressure on the main hydraulic line to close the ball reverses the piston movement and allows a spring bias to close the bypass valve or valves. The equalizing system can be integrated into the barrier valve housing or can be separate as a retrofit.

19 Claims, 2 Drawing Sheets

HYDRAULICALLY CONTROLLED BARRIER VALVE EQUALIZING SYSTEM

FIELD OF THE INVENTION

The field of the invention is barrier valves and more particularly valves for subterranean use that have a pressure equalizing feature that is operated by the control system for opening and closing the valve.

BACKGROUND OF THE INVENTION

Isolation valves are used in subterranean locations for separating one location from another by preventing flow. Some of these devices are safety valves that have the ability to control pressure differential in a direction from below to above. These safety valves have a closure device known as a flapper that is operated by a flow tube that is in turn actuated by a hydraulic piston operated through a hydraulic system controlled at a surface location. In flapper type valves the need to equalize pressure across the flapper when in the closed position has been met with a valve located in the flapper that is first encountered by the flow tube to open a passage through the flapper for pressure equalization before the flow tube pushes the flapper itself to turn 90 degrees to the open position as the flow tube advances past the displaced flapper. Examples of such designs can be seen in U.S. Pat. Nos. 4,478,286; 6,644,408; 6,848,509 and 6,877,564.

Other designs have focused on pressure equalizing across the hydraulic piston that actuates the flow tube in the event there is a seal leak or tubing failure in the control system. In those instances in systems with two control lines there is an equalizing valve in the hydraulic system that can open to put the operating piston in pressure balance so that a closure spring acting on the hydraulic piston pushes up the hydraulic piston and with it the connected flow tube so that the safety valve can close. One example of such a system is U.S. Pat. No. 6,109,351.

The present invention also deals with the concept of pressure equalization across a closed closure member. The reason to equalize pressure across the closure element is to make it possible for the operating system for the closure member to do its job. The control system components do not have to be designed to resist the higher differential pressures which for example can significantly increase seal friction when trying to for example rotate the ball or plug to the open position. There are basically three ways to equalize across a closed valve member before trying to open it. The flow can be equalized either through the member, between the member and one of its seats or between locations on opposed sides of the closed member but spaced apart from the member. In the present invention, the latter option is employed and the normal hydraulic system for opening and closing the valve member is employed in a manner that allows for equalization through passages that are discrete from the hydraulic lines that normally operate the valve member. In essence, in the preferred embodiment, the equalization takes place via the same mechanism that will ultimately open the valve. These and other aspects of the present invention will become more apparent to those skilled in the art from a review of the description of the preferred embodiment and the associated drawings while recognizing that the full scope of the invention is to be determined from the appended claims.

SUMMARY OF THE INVENTION

A barrier valve has an equalizing feature for the ball or plug when in the closed position before it is opened. A hydraulic open and a close line are connected to a housing so that they can move a piston in opposed directions. The piston ends are sealed and the exterior of the piston is tapered to push one or more bypass valves open to connect tubing pressure across the ball when ramped off its seat. Pressure on the main hydraulic line to close the ball reverses the piston movement and allows a spring bias to close the bypass valve or valves. The equalizing system can be integrated into the barrier valve housing or can be separate as a retrofit.

DETAILED DESCRIPTION OF THE PREFERRED EMBODIMENT

Figure 1:
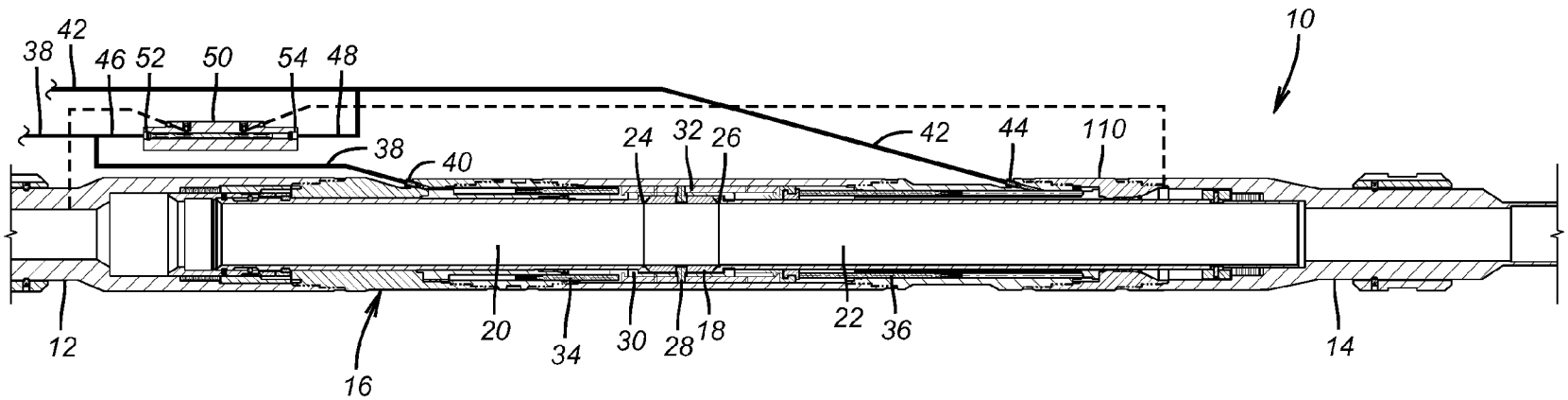
FIG. 1 is an overall view showing the pressure equalizing system associated with the barrier valve.

The valve 10 is shown in FIG. 1. It has a top sub 12 and a bottom sub 14 for connection to a tubing string that is not shown. In between is a multi-component housing that has a ball 18 that is shown in the open position and flanked by sleeves 20 and 22. Sleeves 20 and 22 have at their respective ends that face the ball 18 seals 24 and 26. The ball 18 rotates on axis 28 supported in a frame 32. A movable carriage 30 engages the ball 18 in an offset location from the axis 28 so that opposed translation of the carriage 30 results in rotation of the ball 18 between the open position that is shown and the closed position. Hydraulic pistons 34 and 36 are on opposed sides of the carriage 30 to urge it in opposed direction depending on where the hydraulic pressure is applied. Applying pressure in line 38 at connection 40 pushes the assembly of piston 34, carriage 30 and piston 36 to the right to move the ball 18 to the shown open position. Hydraulic pressure in line 42 at connection 44 moves the carriage 30 and the pistons 34 and 36 in the opposite direction to close the ball 18. Lines 38 and 42 continue to the surface where the controls are located for opening or closing the ball 18 by selectively applying pressure in one of those lines and removing applied pressure from the other. In this manner the operation of the ball 18 is controlled but without any feature for pressure equalization before attempting to operate the ball 18.

The equalization in this design occurs when lines 46 and 48 are connected to the equalizer valve assembly 50. Line 46 branches from line 38 and line 48 branches from line 42. Line 46 connects at connection 52 and line 48 connects at connection 54.

Figure 2:
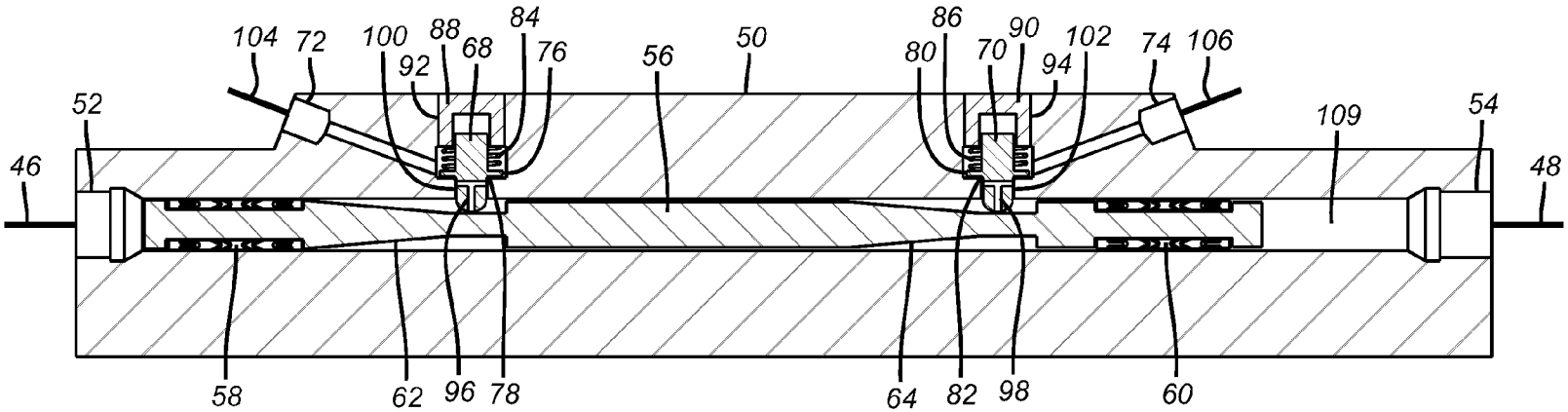
FIG. 2 is the equalizing valve assembly in the closed position.

Referring to FIG. 2 the equalizing valve assembly 50 is shown in more detail. A passage 109 extends between connections 52 and 54. A piston 56 has a seal 58 near connection 52 and a seal 60 near connection 54. Piston 56 is solid and has ramps 62 and 64 that are spaced apart. In the view of FIG. 2 the ball 18 is in the closed position and poppet valves 68 and 70 are both in the closed position to block off connections 72 and 74. Poppet 68 has a flange 76 that is sealing against a seat 78 and poppet 70 has a flange 80 that seals on seat 82. Spring 84 bears on flange 76 to hold it against seat 78. Spring 86 bears on flange 80 to hold it against seat 82. Caps 88 and 90 respectively retain the assemblies of poppets 68 and 70 in the ports 92 and 94. Ports 92 and 94 go into a reduced dimension where the poppets 68 and 70 extend. The reduced dimension defines the seats 78 and 82. At their lower ends the poppets 68 and 70 have a T-shaped passage, respectively, 96 and 98. In the FIG. 2 position the aligned opposed angled ends of the T-shaped passages are up against the reduced bores 100 and 102 formed in the housing 50.

Line 104 carries tubing pressure above ball 18 and extends from the valve housing 16 to connection 72 while line 106 carries tubing pressure and extends from housing 110 and below the ball 18 to connection 74. Annulus 108 extends around piston 56 and between seals 58 and 60. When poppets 68 and 70 ride up ramps 62 and 64 the flanges 76 and 80 lift off the seats 78 and 82 and flow is established for tubing pressure between connections 72 and 74 and pressure on opposed sides of the closed ball 18 is equalized followed by pressure buildup on piston 34 that turns the ball to open. The open sequence is initiated with pressure on line 38 that goes into line 46 to move the piston 56 to the right to a travel stop. That movement ramps out the poppets 68 and 70 and immediately equalizes pressure on closed ball 18 by opening tubing flow between connections 72 and 74. Further pressure buildup beyond what it took to slide the piston 56 against seal friction at seals 58 and 60 shifts the piston 34, the carriage 30 and the piston 36 to the right in FIG. 1 to open the ball 18 after pressure is equalized across it. Putting pressure on line 42 pushes piston 56 to the FIG. 2 position from the FIG. 3 position and allows both poppets 68 and 70 to reseat after riding down ramps 62 and 64.

Figure 3:
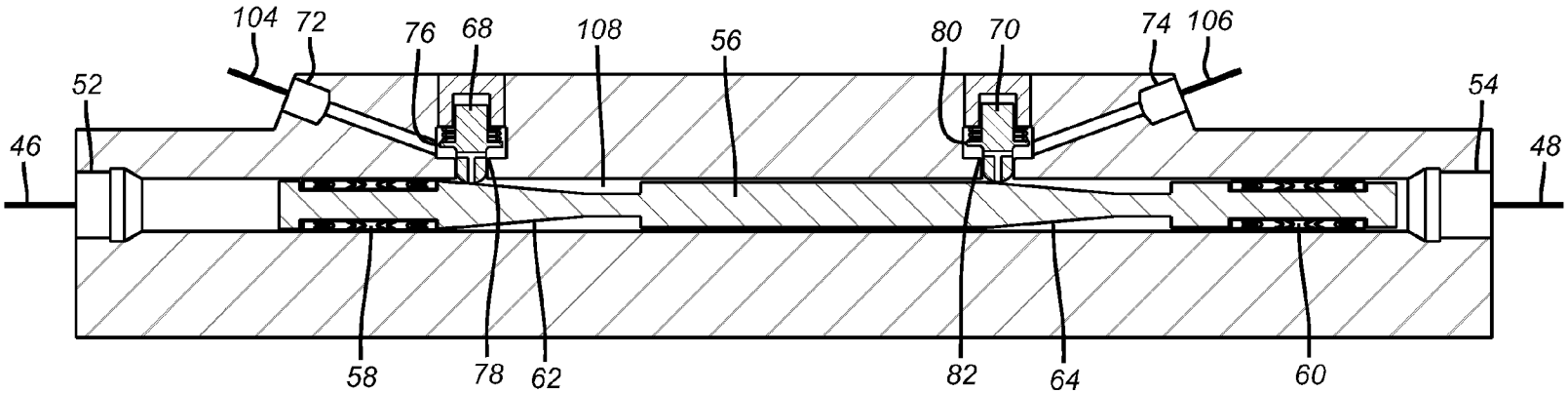
FIG. 3 is the equalizing valve assembly in the open position.

While the housing 50 is shown in FIG. 1 separate from the body 16 of the barrier valve 10, it can just as easily be integrated into the body 16 to take up less space and to facilitate making the tubing connections and to provide greater protection for the structures as an integrated unit. While FIGS. 2 and 3 show the use of a shifting piston ramping out poppets to cause pressure equalization for ball 18 there are other ways to cause that result and they are within the scope of the invention. Those skilled in the art will appreciate that the design allows for normally actuating the closed valve to open from the surface with a pressure applied to one control line and removed from another while automatically getting the benefit of equalizing pressure on the closed ball before the pistons that turn the ball are actuated. It should be noted that in a two control line system as illustrate the assembly is depth insensitive as the hydrostatic pressure in one of the control line is offset with the hydrostatic pressure in the adjacent line for the opposite function. Accordingly piston 56 is in pressure balance hydrostatically as are the operating pistons 34 and 36. Those skilled in the art will appreciate that a single line system can be used instead of a two control line system where the closing force can be provided by a spring assembly either mechanically or pneumatically such as by using a charged pressure chamber. The piston 56 in such systems can also be similarly biased as the operating pistons 34 and 36 to the valve closed position of ball 18.

The illustrated design has advantages over an equalizing method that involves separation of seals 24 or 26 from ball 18. The problem is the separation at ball 18 can cause a momentary high flow situation past the seals 24 or 26 which can erode them to the point of being unserviceable after a predetermined number of cycles. The illustrated equalizing method orients the passages from the connections 72 and 74 at a shallow angle to the seats 78 and 82 so that erosion effects are minimized. In the FIG. 3 position when flow begins into the T-shaped passages 96 or 98 the entering flows abut each other to reduce their velocity and also minimize erosion. Optionally the entire poppet assembly and its mating seat can be a unit that is easily removed from housing 50 after use to put the assembly quickly back into service.

While there concerns regarding seal failures as there would be in any such device, from a perspective of a failsafe operation barrier valves are invariably installed in a well with other safety valves that have systems designed to allow well closure should the illustrated systems develop a seal problem to the point of being inoperable.

The operating personnel need not be concerned with the pressure equalizing before trying to open the valve 10 under differential pressures as high as full working pressure because the feature works automatically to equalize and resets the system when the ball is again closed.

The above description is illustrative of the preferred embodiment and many modifications may be made by those skilled in the art without departing from the invention whose scope is to be determined from the literal and equivalent scope of the claims below.

We claim:

1. A valve for subterranean use, comprising:

a housing having a passage therethrough and a valve member rotatable on a central axis between an open and a closed position for said passage, said valve member dividing said passage into a first and second zone;

a control system for remote hydraulic operation of said valve member between a closed and an open position through pressure in a first conduit that moves an actuator operatively connected to said valve member to rotate said valve member to open, after first equalizing pressure in said passage across said closed valve member by applying pressure in a second conduit that branches from said first conduit and extends to an equalizer valve in said second conduit which selectively opens a tubular equalizer conduit that spans between said first and second zones without communication to pressure outside of said housing.

2. The valve of claim 1, wherein:

a first source of hydraulic pressure in said control system causes said pressure equalizing followed by operation of said valve member to open.

3. The valve of claim 2, wherein:

said first source of hydraulic pressure is connected to a first operating piston for said valve member and to an equalizing valve assembly.

4. The valve of claim 3, wherein:

said equalizing valve assembly is mounted separately from said housing.

5. The valve of claim 3, wherein:

said equalizing valve assembly has a first and a second connection to said passage on opposed sides of said valve member.

6. The valve of claim 5, further comprising:

a least one equalizing valve in said equalizing valve assembly to selectively allow flow between said first and second connections for equalizing passage pressure on said valve member.

7. The valve of claim 6, wherein:

said equalizing valve selectively operated by said first source of hydraulic pressure that operates said first operating piston.

8. A valve for subterranean use, comprising:

a housing having a passage therethrough and a valve member rotatable on a central axis between an open and a closed position for said passage;

a control system for remote hydraulic operation of said valve member between a closed and an open position that initially and automatically in response to applied hydraulic pressure that will subsequently rotate said valve member to open, first equalizes pressure in said passage across said closed valve member;

a first source of hydraulic pressure in said control system causes said pressure equalizing followed by operation of said valve member to open;

said first source of hydraulic pressure is connected to a first operating piston for said valve member and to an equalizing valve assembly;

said equalizing valve assembly has a first and a second connection to said passage on opposed sides of said valve member;

a least one equalizing valve in said equalizing valve assembly to selectively allow flow between said first and second connections for equalizing passage pressure on said valve member;

said equalizing valve selectively operated by said first source of hydraulic pressure that operates said first operating piston;

an equalizing valve piston in said equalizing valve assembly for selective operation of said equalizing valve.

9. The valve of claim 8, wherein:

said equalizing valve piston is mounted in a bore in said equalizing valve assembly so that translation of said equalizing valve piston operates said equalizing valve between an open and closed position.

10. The valve of claim 9, wherein:

said equalizing valve piston comprises spaced seals defining an annular passage extending at least in part between said first and second connections.

11. The valve of claim 10, wherein:

said equalizing valve piston comprises a ramp for selectively moving said equalizing valve in a radial direction to said bore in said equalizing valve assembly.

12. The valve of claim 11, wherein:

said equalizing valve is biased toward a closed position and said bias is selectively overcome with said ramp to open said equalizing valve.

13. The valve of claim 12, wherein:

said equalizing valve comprises a poppet with at least one passage through it through which flow passes when said poppet is separated from a seat by translation of said ramp.

14. The valve of claim 13, wherein:

at least one of said first and second connections feature a sloped passage approaching said seat at an angle of under 20 degrees from said equalizing valve piston bore.

15. The valve of claim 14, wherein:

said at least one equalizing valve comprises a plurality of spaced equalizing valves and said equalizing valve piston comprises a discrete ramp for each said equalizing valve.

16. The valve of claim 15, further comprising:

a second source of hydraulic pressure to offset hydrostatic pressure in said first source of hydraulic pressure and connected to a second operating piston for said valve member for closing said valve member and to an opposite end of said equalizing valve piston from said first source of hydraulic pressure for closing said equalizing valves.

17. The valve of claim 16, wherein:

said first and second sources of hydraulic pressure communicate with opposed ends of said equalizing valve piston and said ramps are disposed between said seals to create discrete fluid passages in said equalizing valve assembly.

18. The valve of claim 16, wherein:

said second source of hydraulic pressure closes said equalizing valves before moving said second operating piston.

19. The valve of claim 18, wherein:

said first and second operating pistons are on opposed sides in said housing from said valve member.

* * * * *